US005835058A

United States Patent [19]

Upton

[11] Patent Number: 5,835,058

[45] Date of Patent: Nov. 10, 1998

[54] ADAPTIVE REFLECTOR CONSTELLATION FOR SPACE-BASED ANTENNAS

[75] Inventor: Eric L. Upton, Redondo Beach, Calif.

[73] Assignee: TRW Inc., Redondo Beach, Calif.

[21] Appl. No.: 887,096

[22] Filed: Jul. 2, 1997

[51] Int. Cl.[6] ..... H01Q 3/00; H01Q 15/20

[52] U.S. Cl. ..... 342/359; 343/915

[58] Field of Search ..... 342/372, 359; 343/915, 754, 755, 912

[56] References Cited

U.S. PATENT DOCUMENTS 5,063,389 11/1991 Reits ..... 342/359
5,084,707 1/1992 Reits ..... 343/754

OTHER PUBLICATIONS

Array Feeds for Reflector Surface Distortion Compensation: Concepts and Implementation, by Yahya Rahmat–Samii, IEEE Antennas & Propagation Magazine, vol. 32, No. 4, Aug. 1990.

*Primary Examiner*—Gregory C. Issing

*Attorney, Agent, or Firm*—Michael S. Yatsko

[57] ABSTRACT

An adaptive antenna array 104 is disclosed. The adaptive antenna array 104 includes a plurality of reflector elements 202 and an array control processor 208 that regulates several resolvers 209, 210, 211 to generate independent magnetic fields. The array control processor 208 also generates reflector element command and control information and transmits the command and control information with a transmitter 218 to the reflector elements 202. The reflector elements 202 include a detector 706 that detects the transmitted command and control information. The reflector elements 202 further include a signal reflector 308 that reflect incident RF energy, a magnetic transceiver 310, and a reflector element controller 314. The reflector element controller 314 is connected to the detector 706 and interprets the command and control information 402. The reflector element controller 314 is also connected to the magnetic transceiver 310 and senses interactions between the independent magnetic fields and the magnetic transceiver 310. In response to the command and control information 402, the reflector element controller 314 generates a control field 908 in the magnetic transceiver 310 that interacts with the independent magnetic fields and motivates the reflector element 202 to the pitch and position in the command and control information 402.

32 Claims, 7 Drawing Sheets

ADAPTIVE REFLECTOR CONSTELLATION FOR SPACE-BASED ANTENNAS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to adaptive antennae for use in spacecraft, including satellites. In particular, the present invention relates to an adaptive antenna that adjusts its beam pattern and corrects for imperfections in a primary collector through the pitch and positional control of a plurality of individual reflector elements.

One ubiquitous satellite element is a transmit / receive antenna that sends or collects beam components that make up a transmitted or received signal. Current space-based antenna technology provides satellites with two generally recognized types of transmit / receive antennae. Those in the art typically refer to the first type of antenna as a fixed pattern antenna.

Fixed pattern antenna are designed on the ground according to the predetermined size, shape, and power requirements of the fixed pattern antenna and the resulting beam components that the fixed pattern antenna will work with. After launch, the satellite uses the fixed pattern antenna to look down upon a ground target with a fixed beam pattern. For example, a satellite in Geosynchronous orbit may use a high power, precisely focused fixed pattern antenna to look down upon and process signals from an area with a highly concentrated population. Fixed pattern antenna, however, face certain difficulties due to their inflexible nature.

One difficulty inherent with fixed pattern antennae is that, by definition, they cannot adapt or change to meet the needs of new markets. For example, a satellite concentrating a beam pattern on a city cannot adjust the beam pattern to cover additional parts of the city as it grows. In addition, if the city population becomes more concentrated in the same area, the fixed pattern antenna cannot adjust the beam pattern to deliver additional energy to the denser area. As a result, potential service subscribers in the city cannot be supported by the beam pattern.

Furthermore, because the antenna is generally fixed in place on the satellite, a satellite that needs to provide fixed coverage for a certain ground location must be in Geosynchronous orbit. Thus, satellites using fixed pattern antenna generally are inefficient in coverage when launched into Medium Earth Orbits (MEOs) or Low Earth Orbits (LEOs).

Although a satellite flying a fixed pattern antenna cannot adjust its beam pattern, certain complex mechanical structures may allow the antenna to adjust the location that the fixed beam pattern covers. In order to provide this capability, previous satellites have included, for example, gimbles on which the satellite guides the fixed pattern antenna (a "gimbled" antenna). Thus, the fixed pattern antenna may be adjusted through a limited range of alternative configurations that provide different ground location coverage. This type of approach suffers from critical drawbacks, however. Not only are these adjustable fixed pattern antenna systems much more expensive, but they also are mechanical (and therefore subject to mechanical stress, wear, and failure), heavy (and therefore more costly to launch), and sophisticated (and therefore more difficult to design and control). As a result, only the most expensive military satellites in the world typically fly moveable fixed pattern antennae.

In response to the shortcomings of a fixed pattern antenna, technology has provided a second type of antenna. Those in the art generally refer to this second type of antennae as a phased array or adaptive beam antenna.

An adaptive antenna generally consists of an array of numerous individual radiating elements. Each radiating element produces or receives a beam component, all of which combined create a beam pattern that covers a ground target or that receives information from a ground transmitter. The number of radiating elements may be, for example, between 50 and 100 or more. Unlike a satellite using a fixed pattern antenna, a satellite flying an adaptive antenna contains sophisticated control circuitry that allows the satellite to change the beam pattern that the adaptive antenna produces.

An adaptive antenna typically does not rely on physical movement of the radiating elements to change the beam pattern. Rather, the satellite phase adjusts and power adjusts each of the beam components fed to the radiating elements such that the combined beam components produce an electronically steered beam pattern. One advantage to this approach is the speed with which the satellite may steer the beam. For example, the time that a satellite needs to adjust an electronically steered beam pattern can be reduced to the order of microseconds. An adaptive antenna, however, suffers from its own set of limitations.

As noted above, a satellite flying an adaptive antenna needs to precisely control the power and phase relationship of each beam component produced by the radiating elements. Typically, the frequencies that a phased array antenna works with may range from a few Megahertz (MHz) to tens of Gigahertz (GHz). Constructing phase shift and power control circuitry that works uniformly over this frequency range is extremely difficult and costly. Furthermore, because of the large number of radiating elements, a satellite using an adaptive antenna includes many sets of complex control hardware (making the satellite expensive), consumes large amounts of power (often a kilowatt or more), and weighs far more than a satellite flying a fixed pattern antenna (thereby increasing launch costs).

The increased power consumption of a satellite using a phased array antenna also leads directly to the need for larger solar panels and on-board batteries. Larger solar panels and batteries, in turn, lead to increased satellite size and weight. In the end, increased size and weight restrict the type of launch vehicle that may launch the satellite, and restricts the launch vehicle to carrying fewer satellites per launch (thereby driving up the satellite system cost even further).

Thus, in the past, increasing the flexibility of a space-based antenna has been impeded by restrictions on satellite antenna size, weight, power, and cost. Furthermore, there is yet another difficulty that space-based antennae must cope with. While in space, antennae are subject to thermal and gravitational effects that often result in deformation or surface distortion in the antenna surface. Surface distortion is particularly noticeable in satellites that fly large fixed pattern reflector antennae (including deployable, erectable, and inflatable reflector antennae). Undesirable effects that stem from surface distortions include transmitted and received beam pattern distortion, reduced antenna gain, and beam component interference.

In the past, the problems associated with surface deformation have been addressed through the use of a corrective apparatus used in conjunction with the surface reflector. The corrective apparatus typically consists of a mechanically controlled deformable reflector placed in the path of the antenna beam pattern. The deformable reflector has a limited number of deformation points that may be adjusted with, for example, servos or small piston rods. A control loop adjusts the deformation points on the deformable surface to correct for distorted portions of the reflector antenna. Deformable surfaces also suffer from certain drawbacks.

As noted above, deformable surfaces are mechanical in nature and therefor suffer from mechanical fatigue and mechanical failure. The deformable surface also requires a large amount of power to perform the mechanical manipulations required to adjust the deformation points. In addition, the mechanical nature of the deformable surface limits the number of deformation points that can fit into a deformable surface (thereby limiting the precision of the corrective apparatus), and adds size and weight to the satellite.

Therefore, a need remains for an improved antenna which overcomes the disadvantages discussed above and previously experienced.

BRIEF SUMMARY OF THE INVENTION

It is therefore an object of the present invention to provide an adaptive antenna array that may correct for surface distortions in an antenna.

It is another object of the present invention to provide an adaptive antenna array that may steer a beam pattern to a variety of ground targets.

It is another object of the present invention to provide a power efficient adaptive antenna array that corrects for surface distortions in an antenna.

It is a further object of the present invention to provide a size efficient adaptive antenna array that corrects for surface distortions in an antenna.

It is a further object of the present invention to provide a weight efficient adaptive antenna array that corrects for surface distortions in an antenna.

It is another object of the present invention to provide a power efficient adaptive antenna array that may steer a beam pattern to a variety of ground targets.

It is a further object of the present invention to provide a size efficient adaptive antenna array that may steer a beam pattern to a variety of ground targets.

It is a further object of the present invention to provide a weight efficient adaptive antenna array that may steer a beam pattern to a variety of ground targets.

It is yet another object of the present invention to provide an adaptive antenna array that is free of mechanical stress and mechanical failure.

It is a further object of the present invention to provide an adaptive antenna array that exercises precise control over the transmitted and received beam pattern through the use of numerous individual adaptive elements.

The present invention provides an adaptive antenna that uses a reflector element control mechanism to manipulate an array (or constellation) of numerous reflector elements. The reflector element control mechanism includes several resolvers (essentially magnetic field generators) that are controlled to provide pitch and position information as well as mobility forces to the reflector elements.

The reflector element control mechanism includes an array control processor that controls the resolvers, and that generates command and control information for each reflector element. A clock signal or other time base reference may form part of the command and control information. In addition, the command and control information contains the pitch and position to which a particular reflector element should move (this is referred to as the commanded pitch and position). A transmitter connected to the array control processor sends the command and control information to the reflector elements. The transmission may be accomplished, for example, by modulating the command and control information and transmitting it on top of a reflector element illumination source.

The reflector elements each include a signal reflector, a magnetic transceiver, and a reflector element controller including a receiver. Each reflector element uses its signal reflector to reflect transmitted RF energy generated by the satellite to a collector antenna, or to reflect received RF energy sent by a ground station and gathered by a collector antenna to a reception focus on the satellite.

The magnetic transceiver can operate as a sensor or as a control field generator. When operating as a sensor, the magnetic transceiver is able to detect the magnetic fields produced by the resolvers under the control of the array control processor. As will be explained below, the sensor operation allows each reflector element to determine its location in space with respect to the resolvers, and thereby provide reference points for pitch and position correction. The magnetic transceiver may also operate as a generator, in which case it produces a magnetic field called a control field.

The reflector element may then use the control field, in conjunction with the magnetic fields produced by the resolvers, to adjust the reflectors pitch and position. Because each reflector element includes a signal reflector, adjustments in the pitch and position of the reflector element will affect the beam components transmitted or received by the satellite. Thus, the array control processor may use the reflector elements to correct for surface distortion in the collector antenna, adjust the beam pattern focus, and control the beam pattern coverage area by adjusting the pitch and position of the reflector elements.

The reflector elements also include a receiver that may be used to receive the command and control information transmitted by the array control processor. The receiver allows each reflector element to receive information concerning, for example, commanded pitch and position. A reflector element controller, included on each reflector element, interprets the commanded pitch and position information. The reflector element controller may then control the magnetic transceiver in an appropriate fashion to adjust the pitch and position of the reflector element. Before the reflector element begins to adjust its pitch or position, the reflector element uses its magnetic transceiver to sense where the reflector element is with respect to the resolvers.

When the magnetic transceiver is operating as a sensor, the reflector element controller interprets the resultant sensing events. For example, the magnetic transceiver may show an induced current that varies with the degree to which a magnetic field generated by a resolver is perpendicular to the magnetic transceiver. As will be explained in more detail below, the reflector element controller may then identify a peak in the induced current. With reference to a clock provided in the command and control information, the reflector element controller may then determine pitch and position reference information to guide future pitch and position changes.

DETAILED DESCRIPTION OF THE INVENTION

Figure 1:
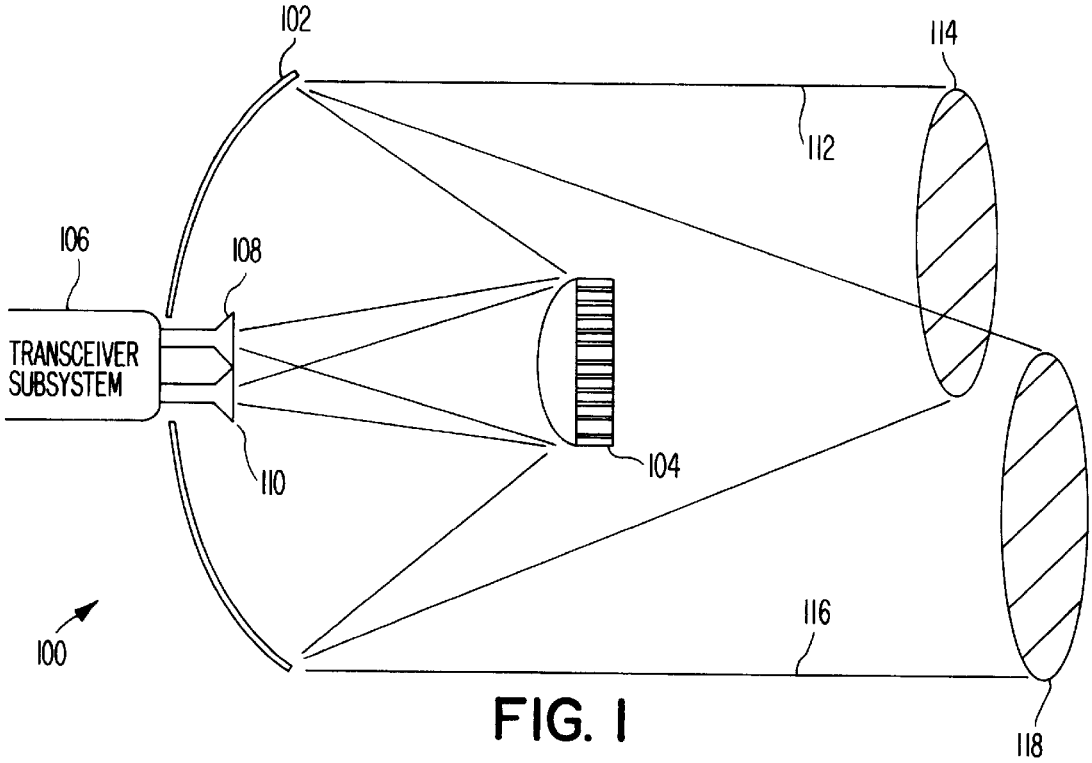
FIG. 1 illustrates one embodiment of an adaptive antenna array working in conjunction with a primary collector antenna.

Turning to FIG. 1, that figure shows an adaptive antenna system 100. The adaptive antenna system 100 includes a primary collector antenna 102, an adaptive array 104, and a satellite transceiver 106. Included in the satellite transceiver 106 are a first feed horn 108 and a second feed horn 110.

The first feed horn 108 generates a first beam pattern 112 that produces a first coverage area 114. Similarly, the second feed horn 110 generates a second beam pattern 116 that produces a second coverage area 118. The first beam pattern 112 and second beam pattern 116 are composed of numerous individual beam components (not shown).

Still with reference to FIG. 1, it can be seen that the adaptive array 104 is in the path of the first and second beam patterns 112 and 116. The adaptive array 104 thereby reflects the first and second beam patterns 112 and 116 to the primary collector antenna 102. As a result, the adaptive array 104 is able to exercise control over the various beam components that constitute the first and second beam patterns 112 and 116.

For example, the adaptive array 104 may adjust its structure to direct the first beam pattern 112 to the first coverage area 114. Similarly, the adaptive array 104 may adjust its structure such that the second beam pattern 116 falls upon the second coverage area 118.

The satellite transceiver 106, the primary collector antenna 102, and the first and second feed horns 108 and 110 may be constructed in a conventional manner. For example, the primary collector antenna 102 may be of the inflatable balloon type that uses a mirrored interior hemisphere surface as the primary collector antenna 102. The construction and operation of the adaptive array 104 is discussed below with reference to FIG. 2*a* and FIG. 2*b*.

Figures 2A, 2B:
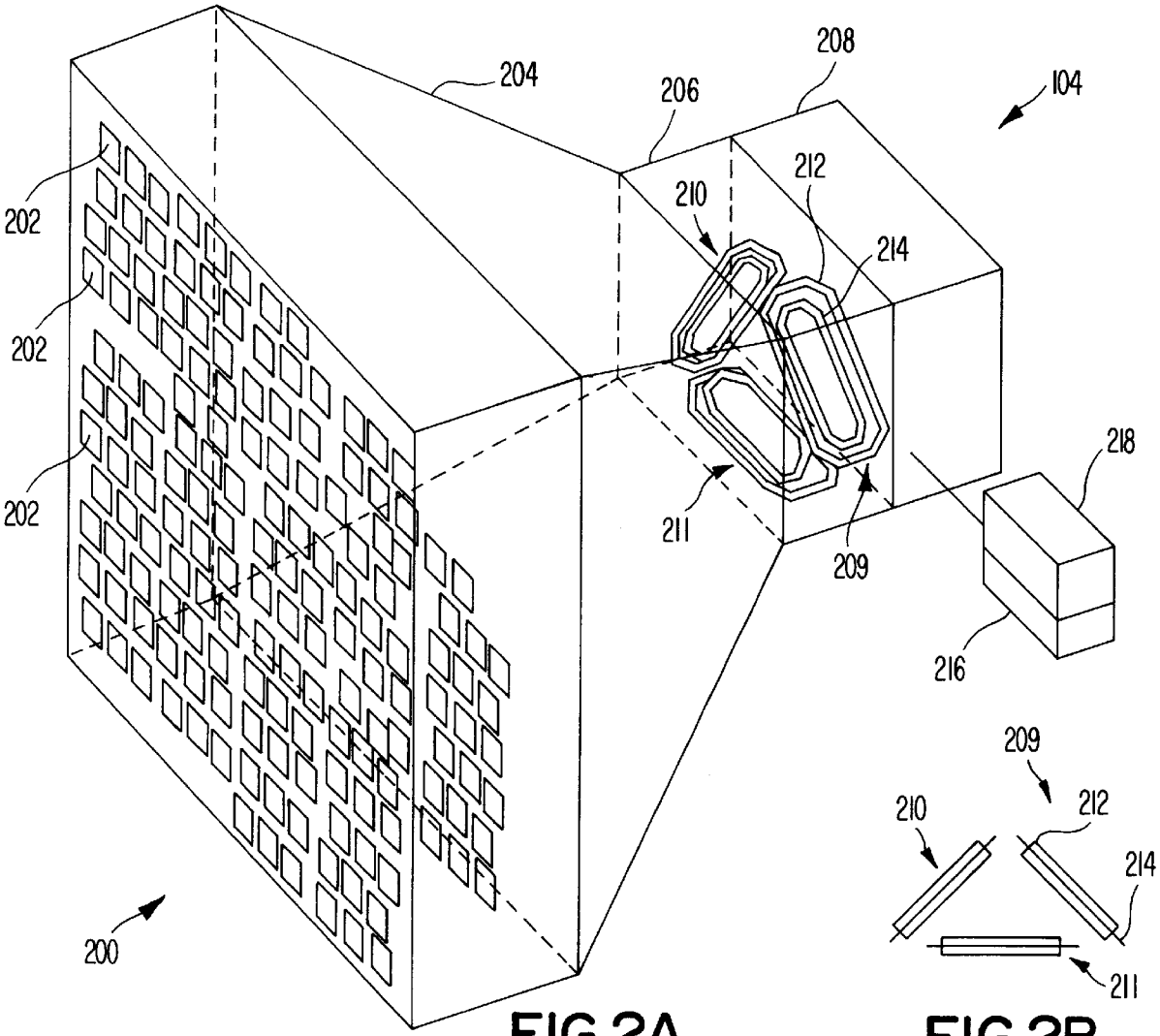
FIG. 2*a* shows one possible construction of an adaptive array.
FIG. 2*b* shows a set of resolvers setup in an equilateral triangle configuration.

Turning to FIG. 2*a,* that figure shows a more detailed diagram of the adaptive array 104 of the present invention. The adaptive array 104 includes a reflector element array 200 which includes numerous reflector elements 202. In a preferred embodiment of the present invention, there are approximately 1600 individual reflector elements 202. The reflector elements 202 are placed in front of a radome 204, which in turn, is located in front of a deflection yoke 206. An array control processor 208 controls the deflection yoke 206. Preferably, the reflector elements 202 are free-floating and therefore unhindered by any mechanical structure which may retard their motion. In concert with the controlled inflation of the primary collector antenna 102, for example, the reflector elements 202 may be released by the satellite during the primary collector antenna 102 initial setup.

The radome 204 helps contain the reflector elements 202 so that they do not drift away before the array control processor 208 establishes control over them. The radome 204 is preferably constructed from a dielectric material transparent to RF energy, including for example, nylon or dacron. As shown in FIG. 2*a,* the radome 204 is constructed to provide a modular, stackable building block that can be repeated to build larger adaptive arrays.

The deflection yoke 206 includes three resolvers, shown in FIG. 2*a* as resolver A 209, resolver B 210, and resolver C 211. In one embodiment of the present invention each resolver consists of a first coil 212 and a second coil 214. The first coil 212 is arranged at a 90 degree angle with respect to the second coil 214 and aligned along the same axis as the second coil 214. In a preferred embodiment, the first coil 212 and second coil 214 are constructed from 40 turns of #20 wire, and a peak current of 4 Amps is used to generate a magnetic field strength of approximately 160 peak Amp-turns. FIG. 2*b* presents a view of resolver A 209 (including the first coil 212, and the second coil 214), resolver B 210, and resolver C 211. Preferably, resolver A 209, resolver B 210, and resolver C 211 are arranged in an equilateral triangle as shown in FIG. 2*a* and FIG. 2*b*. The triangular arrangement facilitates pitch and position detection and control over the reflector elements 202 as will be explained below.

Still with reference to FIG. 2*a,* an illuminator 216 is also shown. One function of the illuminator 216 is to provide a steady light source that impinges on the reflector elements 202. As will be explained below, the reflector elements 202 may include a photovoltaic cell that turns the impinging light into current used to power the reflector element 202. There may be more than one illuminator 216.

The array control processor 208 may drive a transmitter 218 in order to communicate command and control information to the reflector elements 202. In a preferred embodiment, the illuminator 216 performs both illumination and transmission functions. In order to use the illuminator 216 as a transmitter, the array control processor 208 amplitude modulates AM) the command and control information superimposed as a small signal component on the steady state waveform used to drive the illuminator 216. Pulse position, frequency shift key, as well as amplitude modulation may be used in conjunction with the illuminator 216.

Part of the command and control information that the array control processor 208 sends to each reflector element 202 is adjustments to the pitch and position that each reflector element 202 should attain. The adjustments in pitch and position can, for example, correct for surface distortions in the primary collector antenna 102, or refocus the first or second beam pattern 112 or 116 as desired. Although beyond the scope of the present discussion, it is noted that the array control processor 208 may compute the pitch and position adjustments according to adaptive array algorithms.

The adaptive array algorithms evaluate what is known as a "pilot tone" sent from a ground station to the satellite. The pilot tone is derived in part from the satellite transmitted beam pattern. Using the pilot tone as a reference, the adaptive array algorithm is able to determine the pitch and position adjustments for each reflector element 202 needed to refocus the first or second beam pattern 112 or 116 or to correct for imperfections in the primary collector antenna 102. The subsequent adjustments are reflected in a new beam pattern and new pilot tone detection which the algorithms evaluate in a continuous control loop process.

Figure 3A:
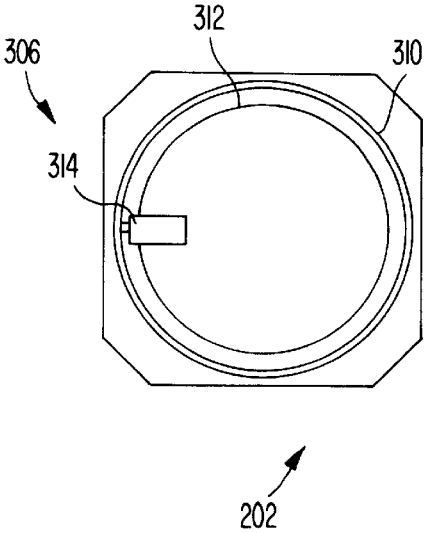
FIG. 3 illustrates a reflector element used to adjust the satellite beam pattern.
Figure 3B:
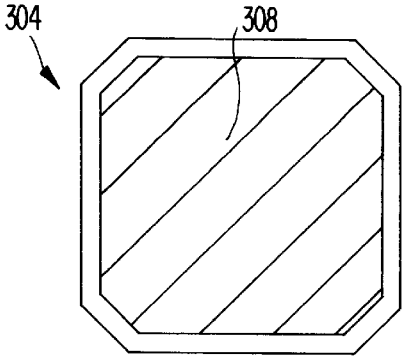

Turning now to FIG. 3, a diagram of a reflector element 202 is shown. The reflector element includes a front plane 304 and a back plane 306. The front plane 304 includes a reflector surface 308 which is adapted to reflect incident RF energy. The back plane 306 includes a magnetic transceiver 310, a power source 312, and a reflector element controller 314. In one embodiment of the reflector element 202, the reflector element 202 is approximately 200 mils in width and length and between 7–9 mils thick.

The front plane 304 and back plane 306 may be manufactured on a silicon substrate, on which the microelectronics comprising the reflector element controller 314, power source 312, and magnetic transceiver 310 may be built. In addition, the front plane 304 may include a layer of suitable reflector material (gold, for example) that serves as the reflector surface 308 and is thicker than the skin depth of the incident RF. Other known RF reflective materials may also be used to implement the reflector surface 308, however.

The power source 312 may consist of a simple photovoltaic cell that converts incident photons into electrical current. In this manner, the reflector element 202 may generate power for the reflector element controller 314 and magnetic transceiver 310. The incident photons may be produced by one or more illuminators 216, which may be strategically placed on the adaptive array 104 to illuminate the reflector elements 202 regardless of their pitch or position. In one embodiment of the present invention, the illuminator 216 produces approximately 100 Watts illumination over the reflector elements 202.

The particular amount of illumination needed will vary with the power requirements of the reflector element 202, which can easily be determined before satellite launch. In a preferred embodiment of the invention, the reflector element 202 implements the reflector element controller 314 using as much Complementary Metal Oxide Semiconductor (CMOS) structure as possible in order to reduce power requirements. In another preferred embodiment, the reflector element controller 314 is implemented with low power analog devices.

In other embodiments of the reflector element 202, the reflector element 202 may carry alternative structure that provides the power source 312. For example, the power source 312 may include a battery, solar cell, or other current generating device in order to provide power for the reflection element controller 314 and magnetic transceiver 310.

The magnetic transceiver 310 is able to sense incident magnetic fields. The magnetic transceiver 310 produces current proportional to the angle at which the incident magnetic field crosses the magnetic transceiver 310. A magnetic field perpendicular to the magnetic transceiver 310 will, therefore, generate the greatest amount of current in the magnetic transceiver 310. As will be explained in greater detail below, the reflector element controller 314 may detect current peaks in the magnetic transceiver 310 and thereby discern certain pitch and position reference information.

The magnetic transceiver 310 may be implemented in a variety of manners. For example, a densely packed coil containing a number of turns of wire or other conducting material may be used. In a preferred embodiment of the present invention, the magnetic transceiver 310 is a Helmholtz coil etched directly into the back plane 306 using semiconductor photolithographic manufacturing techniques to produce 300 turns of 2 micron wide conductive traces.

The reflector element controller 314 may also use the magnetic transceiver 310 also used to generate a magnetic field, hereafter referred to as a control field. The control field will interact with the magnetic fields generated by resolver A 209, resolver B 210, and resolver C 211 under the control of the array control processor 208 to provide pitch and position adjustment for the reflector element 202.

The control field may be generated by the operation of the reflector element controller 314. In order to generate the control field, for example, the reflector element controller 314 may divert current produced by the power source 312 into the magnetic transceiver 310. As a result, current will flow around the conductors comprising the magnetic transceiver 310 and thereby generate the control field. In one embodiment of the present invention, approximately 30 milliamps (ma) of current is diverted into the magnetic transceiver 310) to produce a magnetic field strength of approximately 9 Amp-turns. No current, however, is diverted through the magnetic transceiver 310 during a sensing operation.

It can be seen that the sensing operation of the magnetic transceiver 310 differs slightly from the control field operation of the magnetic transceiver 310. During the sensing operation, the reflector element controller 314 does not divert current into the magnetic transceiver 310, but rather senses current induced into the magnetic transceiver 310 by incident magnetic fields produced by the resolvers 210 under control of the array control processor 208.

The reflector element controller 314 is responsible for the pitch and position control of the reflector element 202. As will be explained in greater detail below, the reflector element controller 314 also includes a detector and data formatter used to receive command and control transmissions, as well as circuitry that is able to sense, compare, and store values representative of the induced current present in the magnetic transceiver 310.

The operation of the adaptive array 104 can be broadly divided into three repetitive and overlapping stages. First, the array control processor 208 establishes communication and synchronization with each reflector element 202. Second, each reflector element 202 determines its pitch and position in space. Finally, the array control processor directs an electromotivating force that the reflector elements 202 use to adjust their pitch and position.

Establishing Communication and Synchronization

One method of communication between the array control processor 208 and the reflector element 202 uses the illuminator 216. A conventional modulation technique, for example, AM, allows the array control processor 208 to add information on top of the steady state optical waveform used to drive the illuminator 216.

The result is a transmitted light pattern that not only provides power for the reflector element 202, but also transmits information that the reflector element 202 may interpret using a dectector and data formatter.

Because there are multiple reflector elements 202 used in the adaptive array, a preferred embodiment of the present invention assigns a unique address or ID to each reflector element 202. Subsequently, the array control processor 208 may transmit reflector-specific information to individual reflector elements 202. One convenient way to transmit reflector-specific information to the reflector elements 202 is to use a Time Division Multiplex (TDM) scheme in conjunction with a predetermined data frame. In one embodiment of the present invention, the array control processor 208 transmits TDM data at 100 Kbps (bits per second).

Figure 4:
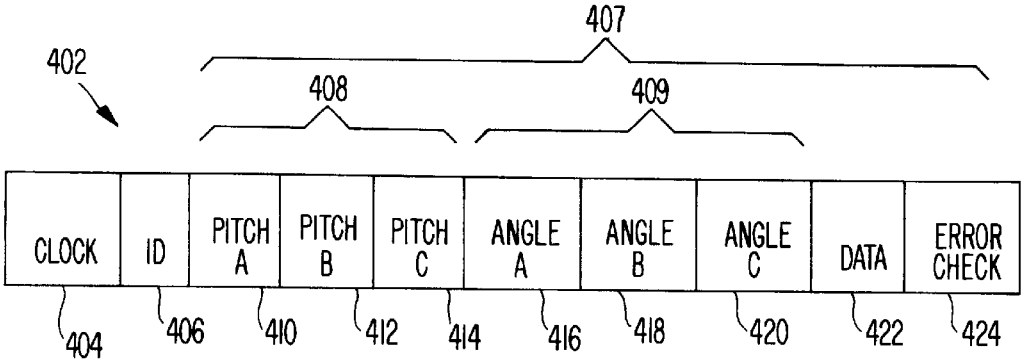
FIG. 4 shows the format of a communications frame sent to the reflector elements.

FIG. 4 shows an example of a TDM frame format that may be used to communicate information to the reflector element 202. Included in the TDM frame 402 is a clock field 404, a reflector element ID field 406, and a data field generally indicated as 407. The data field 407 includes pitch fields 408 that command the reflector element 202 to adjust its pitch. In particular, the reflector element 202 adjusts its pitch with respect to resolver A 209 according to pitch-A field 410, further adjusts its pitch with respect to resolver B 210 according to a pitch-B field 412, and finally adjusts its pitch with respect to resolver C according to pitch-C field 414. The pitch adjustment process will be discussed in more detail below.

The data field 408 further includes position fields 409 that have the effect of commanding the reflector element 202 to move to a particular X, Y, and z position with respect to resolver A 209, resolver B 210, and resolver C 211. In particular, the reflector element 202 adjusts its position with respect to resolver A 209 according to angle-A field 410, further adjusts its position with respect to resolver B 210 according to a angle-B field 412, and finally adjusts its position with respect to resolver C according to angle-C field 414. The position adjustment process will be discussed in more detail below.

Optionally, the data field 407 may include an error checking field 424 or a communication field 422 containing additional information or commands for the reflector element 202. The error checking field 424 may use any known error detection or correction code to provide error detection and correction capabilities with respect to the transmitted information in the TDM frame 402.

As noted above, the pitch fields 408 and the position fields 409 may contain pitch and position information for each reflector element 202 with respect to resolver A 209, resolver B 210, and resolver C 211. In a preferred embodiment of the present invention, the pitch fields 408 contain data relating to the strength of the current induced by resolver-generated magnetic fields in the reflector element 202, while the position fields 409 contain data relating to the time at which resolver-generated magnetic fields pass through the reflector element 202.

In one embodiment of the present invention, each pitch and position is encoded in an 8-bit quantity, thereby providing 256 possible assignments for each of the position fields 409 and pitch fields 407. In general, however, a greater or lesser number of bits may be used to provide more or less angular or temporal resolution.

As noted above, the incident light produced by the illuminator 216 may be used by the power source 312 to provide current for the reflector element controller 314. In addition, the reflector element controller 314 will generally include a conventional detector and data formatter to capture the information on the incoming light pattern and access the information in the TDM frame 402. The reflector element controller 314 may then use the information in the TDM frame 402 to adjust its pitch and position, as will be explained shortly. Before the reflector element 202 adjusts its pitch and position, however, the reflector element 202 generally synchronizes its internal clock with the array control processor 208.

The clock field 404 provided by the array control processor 208 establishes a time base at the reflector element controller 314. The reflector element controller 314 uses the time base to synchronize its internal clocking to that of the array control processor 208. The clock field 404 may consist, for example, of a unique data pattern. The reflector element controller 314 may then check and correct its internal clock source with the unique data pattern it receives on the repetitive TDM frame 402.

Determining Pitch and Position

Before a reflector element 202 adjusts its pitch and position according to the pitch and position commands in the TDM frame 402, the reflector element 202 determines the difference between its current pitch and position in space and its commanded pitch and position. Resolver A 209, resolver B 210, and resolver C 211 are instrumental in providing the reflector element 202 with the means to determine the error in the reflector element 202 current pitch and position.

Figure 5:
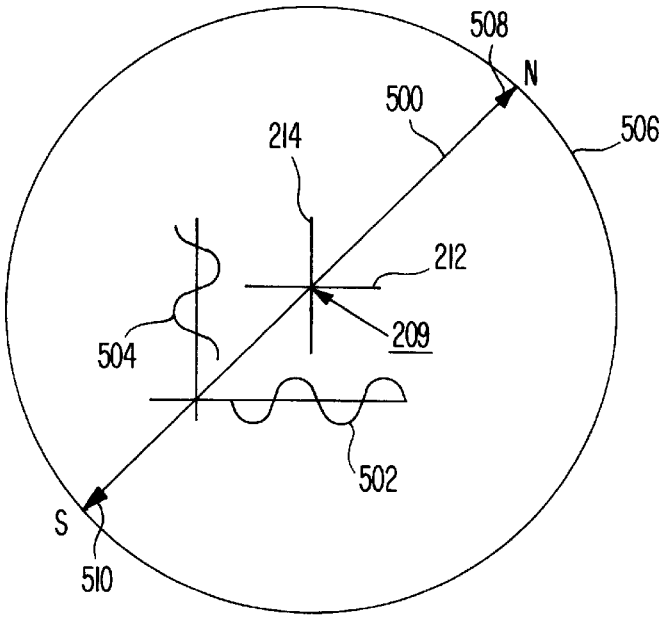
FIG. 5 shows a resolver generating a magnetic field.

Turning now to FIG. 5, that figure shows resolver A 209 generating a resultant magnetic field 500. Although FIG. 5 will be discussed with reference to resolver A 209, the discussion applies equally to resolver B 210 and resolver C 211. The first coil 212 is driven by a sine-wave varying current 502. The second coil 214 is driven with a cosine-wave varying current 504 with the same frequency as the sine-wave varying current 502.

Because current flow generates a magnetic field, the first coil 212 and second coil 214 individually generate net magnetic fields perpendicular to the plane of the respective coils. The vector sum of the two individual magnetic fields produces a resultant magnetic field 500 that rotates around the axis of resolver A 209 as shown in FIG. 5 by the circular path 506. When the peak values of the sine-wave varying current 502 and cosine-wave varying current 504 are equal, then the magnitude of the resultant magnetic field 500 is constant. The eccentricity of the circular path 506 may therefore be controlled by adjusting the peak values of the sine-wave current 502 or cosine-wave current 504. As noted above, a preferred embodiment of the present invention uses peak current values of 4 Amps to generate a resultant magnetic field 500 with a strength of approximately 160 peak Amp turns.

The resultant magnetic field 500 may be considered a plane wave that rotates around resolver A 209. In a preferred embodiment, resolver A 209, resolver B 210, and resolver C 211 are arranged in an equilateral triangle so that the resultant magnetic field 500 produced by each resolver thus lies in a unique plane.

Still with reference to FIG. 5, that figure shows that the resultant magnetic field 500 has a North pole 508 and a South pole 510. A North pole and South pole are inherent properties of magnetic fields. The rate at which the resultant magnetic field 500 rotates depends on the frequency of the sine-wave current 502 and the cosine-wave current 504. In one embodiment of the present invention, the frequency is 8 KHz. While the reflector element 202 is determining its reference pitch and position information, resolver A 309, resolver B 310, and resolver C 311 sequentially generate resultant magnetic fields 500. The reflector element 202 can then determine the error in its position with respect to resolver A 309, resolver B 310, and resolver C 311.

During the phase in which the reflector element controller 314 is determining its position in space, it is also synchronized to the array control processor 208 time base. Thus, the reflector element controller 314 knows when the resultant magnetic field 500 is being generated, and how far the resultant magnetic field 500 has rotated, at any given time, around resolver A 209, resolver B 210, or resolver C 211.

As the resultant magnetic field 500 rotates, it induces a current in the reflector element 202 magnetic transceiver 310. The reflector element controller 314 monitors the strength of the induced current in the magnetic transceiver 310, and also notes the time at which the induced current was at a maximum.

When the induced current is at a maximum, the resultant magnetic field 500 is passing directly through the reflector element 202 and the magnetic transceiver 310. Because the reflector element controller 314 is synchronized to the array control processor 208, the reflector element controller 314 can determine the time at which the resultant magnetic field 500 passed through the reflector element 202.

Figure 6:
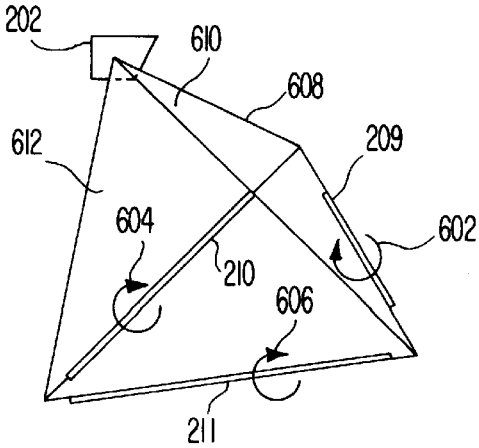
FIG. 6 shows the geometry of a three resolver system that pinpoints a location in space.

The geometry involved in the above discussion is shown in FIG. 6. FIG. 6 shows a reflector element 202 that has determined a first angle 602, second angle 604, and a third angle 606 at which the induced currents produced by the resultant magnetic fields 608, 610, and 612 controlled by resolver A 209, resolver B 210, and resolver C 211 respectively, are maximum. Applying established trigonometric and geometric theory, there is a unique point at which the three planes of the resultant magnetic fields 500 intersect. Thus, the array element controller 208 can command the reflector element 202 to a particular position in space by providing an angle-A field 416, an angle-B field 418, and an angle-C field 420. In practice, the angle-A field 416, angle-B field 418, and angle-C field 420 may contain the time at which the resultant magnetic field 608, 610, and 612 should pass through the reflector element 202 when it is in the correct position thereby determining the first angle 602, second angle 604, and third angle 606.

As discussed above, the reflector element controller 314 is able to determine the time at which the resultant magnetic fields 608, 610, and 612 pass through the reflector element 202. As a result, the reflector element controller can also determine the difference between its current location and where it has been commanded to go. As discussed below, the difference may then be used in a control loop to move the reflector element 202 to its commanded position.

The reflector element 202 uses a similar procedure to determine its pitch with respect to resolver A 209, resolver B 210, and resolver C 211. Note that the maximum induced current occurs when the magnetic transceiver 310 is perpendicular to the resultant magnetic field 500. Therefore, by providing pitch fields 408 that contain values for the induced current that will flow through the magnetic transceiver 310 when the reflector element 202 has the proper pitch, the reflector element controller 314 may determine the pitch error in the reflector element 202. As will be explained below, once the reflector element controller 314 knows the proper value of induced current, the reflector element controller 314 may adjust the reflector element 202 so that it attains the proper pitch with respect to resolver 209, resolver B 210, and resolver C 211.

Adjusting Pitch and Position

Figure 7:
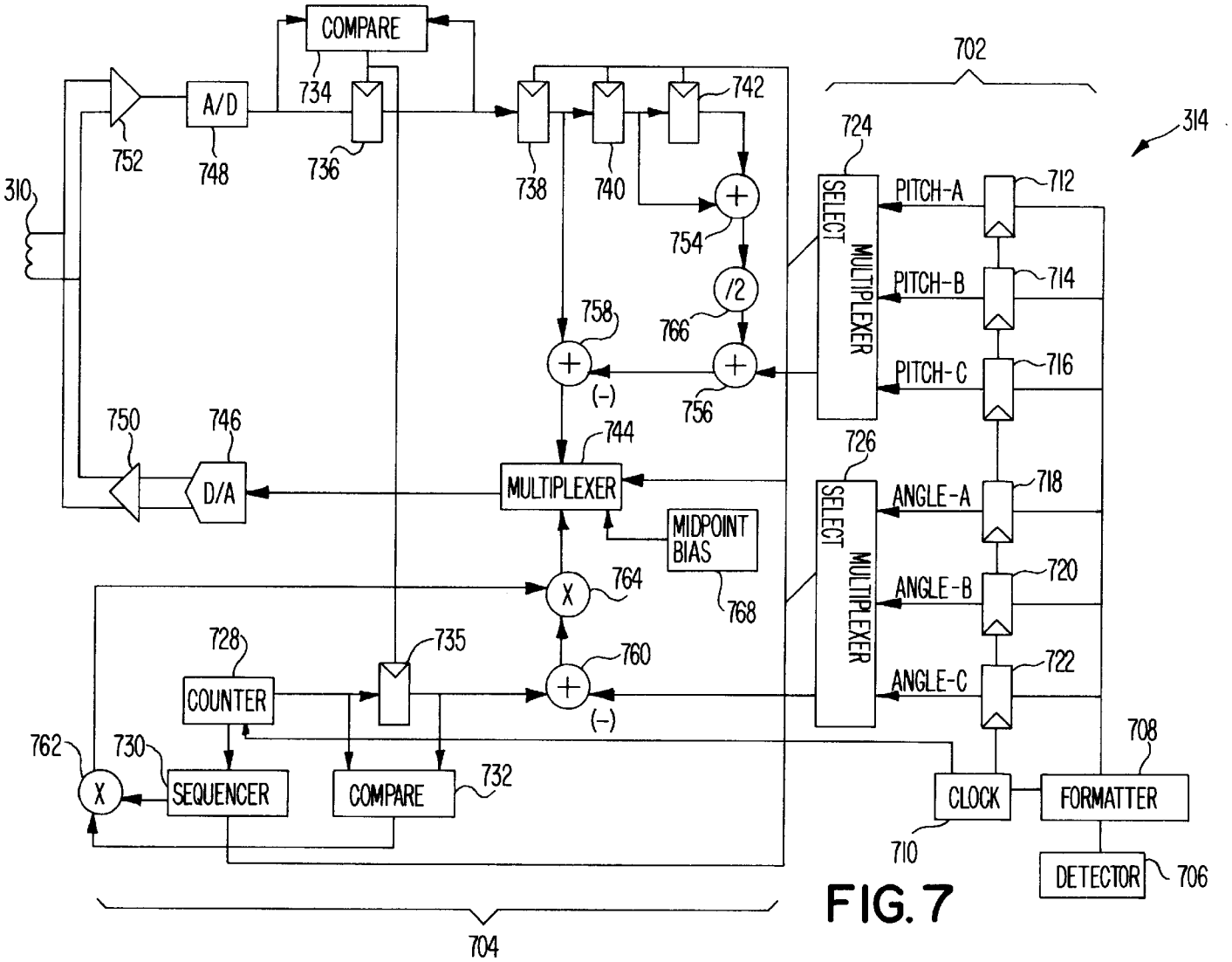
FIG. 7 shows a block diagram of a reflector element controller.

The reflector element controller 314 is able to change the pitch and position of the reflector element 202 through the use of the magnetic transceiver 310. As noted above, the reflector element controller 314 is able to determine its pitch and position error with reference to its commanded pitch and position. Turning now to FIG. 7, a block diagram of a reflector element controller 314 is shown that uses the determined pitch and position error to adjust the reflector element 202 to its commanded pitch and position.

The reflector element controller 314 includes command setup section 702 and a control loop section 704. The command setup section 702 includes a detector 706, formatter 708, and a clock 710. The command setup section 702 further includes a register set including a pitch-A register 712, a pitch-B register 714, a pitch-C register 716, an angle-A register 718, an angle-B register 720, and an angle-C register 722. Pitch multiplexer 724 is connected to the pitch-A, pitch-B, and pitch-C registers 712, 714, and 716. In addition, angle multiplexer 726 is connected to the angle-A, angle-B, and angle-C registers 18, 720, and 722.

The control loop section 704 includes a counter 728 (controlled by the clock 710), a sequencer 730, and comparators 732 and 734. The control loop section 704 also includes registers 735, 736, 738, 740, and 742 in addition to a segment multiplexer 744, digital to analog (D/A) converter 746, analog to digital (A/D) converter 748, and buffers 750 and 752. Interconnections between the devices in the control loop section 704 include adders 754, 756, 758, and 760 as well as multipliers 762 and 764 and divider 766. Note that the magnetic transceiver 310 is connected to the buffers 750 and 752 such that the magnetic transceiver 310 may be driven by the buffer 750 or sensed by the buffer 752. Furthermore, a midpoint bias 768 is connected to the segment multiplexer 744.

As noted above, the illuminator 216 preferably transmits modulated information to the reflector element 202. At the reflector element controller 314, the detector 706 receives the transmission from the illuminator 216. The photovoltaic cell, for example, may be used for this purpose. The detected signal is subsequently formatted by formatter 708 to produce a received TDM frame as discussed above in connection with FIG. 4. The output of the formatter is connected to the clock 710 and the registers 712–722.

The clock 710 extracts the clock symbol from the TDM clock field and thereby synchronizes to the time base in the array element controller 208. The clock 710 also provides independent clock signals to the registers 712–716 such that the pitch-A field in the TDM frame is stored in the pitch-A register 712, the pitch-B field in the TDM frame is stored in the pitch-B register 714, and the pitch-C field in the TDM frame is stored in the pitch-C register 716. In addition, the clock 710 provides independent clock signals to the registers 718–722 such that the angle-A field in the TDM frame is stored in the angle-A register 718, the angle-B field in the TDM frame is stored in the angle-B register 720, and the angle-C field in the TDM frame is stored in the angle-C register 722.

Figure 8:
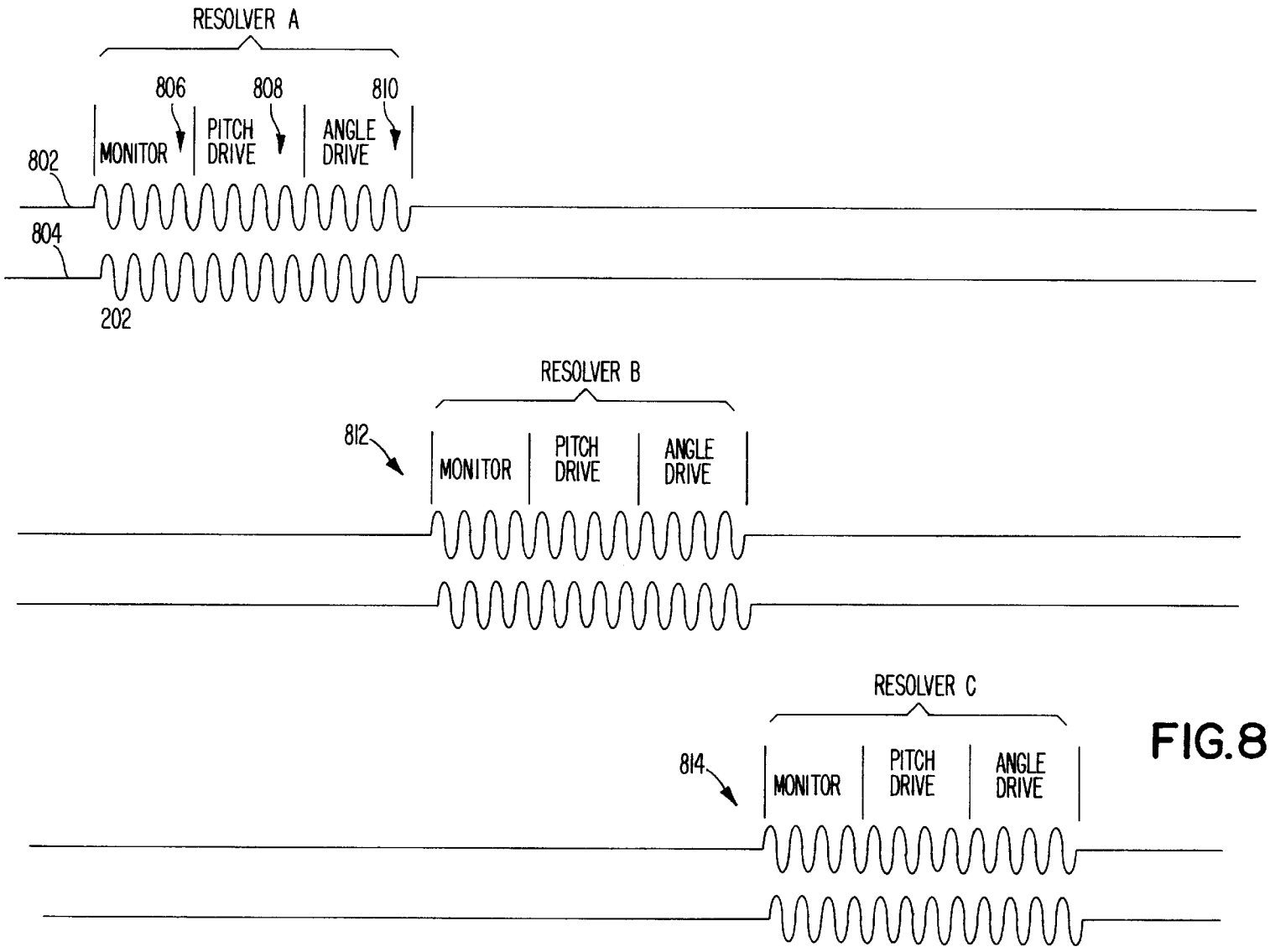
FIG. 8 illustrates one set of array control processor resolver waveforms.

The operation of the control loop section 704 will be discussed in conjunction with FIG. 8. FIG. 8 shows the sine-wave current waveform 802 and cosine-wave current waveform 804 that may be used to drive the first coil 212 and second coil 214 of, for example, resolver A. As shown in FIG. 8, the operation of the reflector element controller may be broken down into three time segments: the monitor segment 806, the pitch drive segment 808, and the angle drive segment 810. Although FIG. 8 will be discussed in detail with reference to resolver A, it is noted that the discussion applies equally to the resolver B waveforms, generally indicated as 812 and the resolver C waveforms, generally indicated as 814.

In a preferred embodiment of the present invention, the duration of the monitor segment 806, the pitch drive segment 808, and the angle drive segment 810 are each 1 millisecond (e.g., 8 cycles of current at 8 Khz). Note that the reflector element controller 314 is aware of when the monitor segment 806 begins. In fact, the reflector element controller 314 can determine when each segment begins because the clock 710 is synchronized to the array element controller 208 that generates the sine wave current 802 and the cosine wave current 804.

Beginning with the monitor segment 806, and referring again to FIG. 7, the resultant magnetic field produced by resolver A 209 (as noted above with reference to FIG. 5) induces current in the magnetic transceiver 310. During the monitor segment 806, the D/A converter 746 is either disabled or prevented from driving the magnetic transceiver 310, for example by isolation with buffer 750.

In a preferred embodiment of the present invention, the midpoint bias 768 provides the segment multiplexer 744 with a midpoint input that is selected by the segment multiplexer 744 during the monitor segment 806. The midpoint input is selected for the D/A converter 746 such that the D/A converter 746, when presented with the midpoint input, produces no current in the magnetic transceiver 310.

The induced current in the magnetic transceiver 310 is buffered and conditioned by the buffer 752 and then sampled by the A/D converter 748. The comparator 734 produces a clock pulse to register 736 when it detects that the sampled value of induced current is greater than value stored in register 736. In response, the register 736 stores the sampled value. Thus, the comparator 734 and register 736 provide the functionality of a peak detector. In addition, the clock pulse is connected to register 735. Because the output of the counter 728 is connected to the register 735, register 735 will hold the time at which the peak current was detected.

Note also that the peak current during the operation of resolver A is stored in register 738. During the operation of resolver B 310, the value stored in register 738 propagates to register 740, and register 738 stores the maximum induced current for resolver B. Likewise, the values stored in registers 738 and 740 propagate to registers 740 and 742 respectively during the operation of resolver C. Therefore, in the steady state, at the beginning of the pitch drive segment 808, register 738 contains a value 'RA' representing the maximum current induced by resolver A, register 742 contains a value 'RB' representing the maximum current induced by resolver B, and register 740 contains a value 'RC' representing the maximum current induced by resolver C.

Once the array control processor 208 has completed the monitor segment 806, the pitch drive segment 808 follows. In the following discussion, "pitch" will refer to both the roll angle and the pitch angle of the reflector element 202. It is noted that resolver A 209 is able to make the reflector element 202 change its pitch bout the axis of resolver A. Similarly, resolver B 210 and resolver C 211 can cause the reflector element 202 to change its pitch about the axis of resolver B 210 and resolver C 211, respectively. In a preferred embodiment, the resolver A 209, resolver B 210, and resolver C 211 are arranged in an equilateral triangle with their axes 120degrees away from each other. Thus, the reflector element 202 may have its pitch adjusted to any roll angle and any pitch angle by using a combination of resolver A 209, resolver B 210, and resolver C 211.

The pitch drive segment 808 begins with the sequencer 730 checking the counter 728 output to determine that the pitch drive segment 808 has begun. As a result, the sequencer 730 selects the pitch-A output, 'PA', of the pitch multiplexer 724. The adder 758 uses the stored values of RA, RB, RC, and PA to compute RA−0.5 (RB+RC)−PA. (The corresponding computation for resolver B is RB−0.5 (RC+RA)−PB and for resolver C is RC−0.5 (RB+RA)−PC.

When the reflector element 202 has the correct pitch with respect to resolver A 209, the maximum induced current in the magnetic transceiver 310, RA, will satisfy RA−0.5 (RB+RC)−PA=0. It is noted that adaptive array algorithms processed by the array control processor 208 are responsible for taking into consideration the geometry of the resolvers and generating the appropriate values of PA, PB, and PC. The control loop section 704 uses resolver A 209, resolver B 210, and resolver C 211 in concert to adjust the reflector element 202 pitch to the correct roll angle and pitch angle for the reflector element 202 calculated by the array element controller 208. Because the reflector element 202 uses a magnetic transceiver 310 that generates a control field perpendicular to the plane of the magnetic transceiver 310, the control field does not affect the yaw of the reflector element 202. Because a change in yaw represents a rotation of the reflector element 202 in the plane, a change in yaw would have no effect on the reflection of RF energy by the reflector surface 308.

When there is an error in the reflector element 202 pitch with respect to resolver A, the output of adder 758 will be non-zero (the "error value"). When the output of adder 758 is non-zero, the D/A converter uses the error value to generate a control field that will rotate the reflector element 202 during the pitch drive segment 808.

The D/A converter 746 uses the error value to produce current in the magnetic transceiver 310 and thereby produce a control field perpendicular to the magnetic transceiver 310. Because the control field, like all magnetic fields, has a North pole and a South pole, the reflector element 202 is repelled or attracted by the North pole or South pole of the resultant magnetic field produced by resolver A (described above with reference to FIG. 5) during the pitch drive segment 808.

The interaction between the control field and the resultant magnetic field results in the rotation of the reflector element 202. Note that a larger error value corresponds to a larger control field and therefore a faster reaction to the resultant magnetic field produced by resolver A. In a preferred embodiment, the current used to generate the control field for the pitch drive segment 808 is greater than the current used for to generate the control field for the angle drive segment 810. For example, twice as much current may be used to produce the control field so that the reflector element 202 responds much more quickly and forcefully to the pitch control. This will allow the reflector element 202 to line up quickly in the direction that it will translate during the angle drive segment 810, and prevent the translation forces from rotating the reflector element 202 out of position.

Figure 9A:
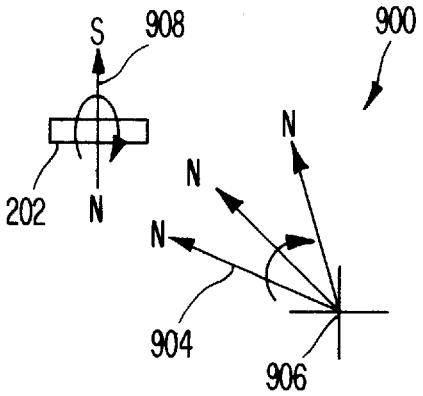
FIG. 9*a* shows the magnetic fields involved in producing a clockwise pitch in a reflector element.
Figure 9B:
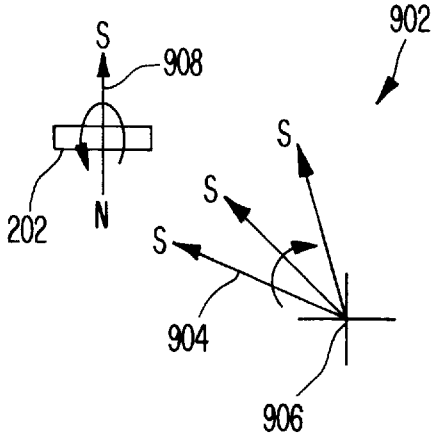
FIG. 9*b* shows the magnetic fields involved in producing a counterclockwise pitch in a reflector element.

Reflector element pitch control is illustrated in FIGS. 9*a* and 9*b*. FIG. 9*a* shows a clockwise pitch adjustment 900 while FIG. 9*b* shows a counter clockwise pitch adjustment 902. In the clockwise pitch adjustment 900, the North pole of the resultant magnetic field 904 produced by resolver A 906 is shown rotating around the axis of resolver A 906 (as described above with reference to FIG. 5). In addition, the reflector element 202 is shown producing a control field 908. The control field 908 and resultant magnetic field 904 interact (e.g., the North pole of the control field is repelled by the North pole of the resultant magnetic field 904) to produce the net result, as shown in FIG. 9*a,* of clockwise rotation.

The amount of error in the reflector element 202 pitch computed by adder 758 determines the magnitude of the control field 908 and therefore the rate at which the reflector element 202 rotates.

Similarly, FIG. 9*b* shows a counterclockwise pitch adjustment 902. In the counterclockwise pitch adjustment 902, the South pole of the resultant magnetic field 904 produced by resolver A 906 is shown rotating around the axis of resolver A 906. In addition, the reflector element 202 is shown producing a control field 908. The control field 908 and resultant magnetic field 904 interact (e.g., the South pole of the control field is repelled by the South pole of the resultant magnetic field 904) to produce the net result, as shown in FIG. 9*b,* of counterclockwise rotation. Again, the amount of error in the reflector element 202 pitch computed by adder 758 determines the magnitude of the control field 908 and therefore the rate at which the reflector element 202 rotates. The sign of the error in the reflector element 202 pitch determines the polarity of the current generated by the D/A converter 746 and therefore the direction of rotation of reflector element 202. Note also that, in general, the reflector element 202 will change its pitch angle and its roll angle in response to the resultant magnetic field 904.

Once the array control processor 208 has completed the pitch drive segment 808, the angle drive segment 810 follows. The sequencer 730 checks the counter 728 output to determine that the angle drive segment 810 has begun. As a result, the sequencer 730 selects the angle-A output of the angle multiplexer 726. In addition, segment multiplexer 744 is set to select the output of the adder 760. Note that adder 760 inverts the input produced by the angle multiplexer 726. Thus, the adder 760 (and therefore segment multiplexer 744) produces the time difference between when the induced current was maximum (stored in register 735) and the time at which the current should be maximum (provided in the TDM frame and stored in angle-A register 718). The time difference is used to drive the D/A converter 746 and thereby produce a control field in the magnetic transceiver 310. It is noted that adaptive array algorithms processed by the array control processor 208 are responsible for taking into consideration the geometry of the resolvers and generating the appropriate values of Angle-A, Angle-B, and Angle-C.

Because the control field, like all magnetic fields, has a North pole and a South pole, the reflector element 202 is repelled or attracted by the North pole or South pole of the resultant magnetic field 500 produced by resolver A. This results in the translation of the reflector element 202. Note that a larger time difference corresponds to a larger control field and therefore a faster translation to the resultant magnetic field 500.

In order to effectively translate the reflector element 202, the polarity of the current produced by the D/A converter 746 is reversed as the resultant magnetic field 500 passes through the reflector element 202. Comparator 732 detects when this occurs by checking the current counter 728 value against the counter value stored in register 735 (corresponding to maximum induced current and the time at which the resultant magnetic field 500 passed through the reflector element 202). When the current counter 728 value indicates that the resultant magnetic field 500 has passed through the reflector element 202, the multipliers 762 and 764 reverse the sign of the digital data used to drive the D/A converter 746. The sign reversal inverts the polarity of the current produced by the D/A converter 746. The North and South pole of the control field is therefore reversed.

Figure 10A:
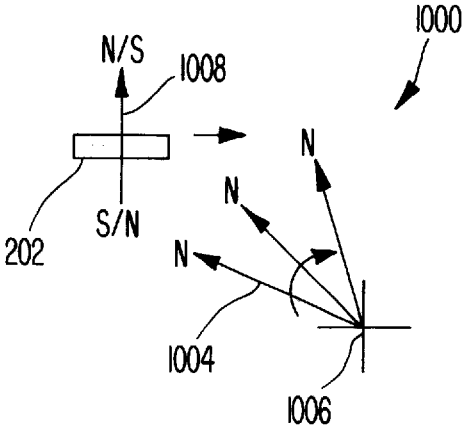
FIG. 10*a* shows the magnetic fields involved in producing a positive translation in a reflector element.
Figure 10B:
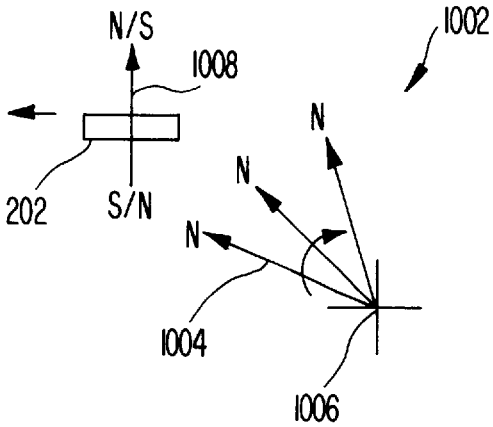
FIG. 10*b* shows the magnetic fields involved in producing a negative translation in a reflector element.

Reflector element translation is illustrated in FIGS. 10*a* and 10*b*. FIG. 10*a* shows a positive translation adjustment 1000 while FIG. 10*b* shows a negative translation adjustment 1002. In the positive translation adjustment 1000, the resultant magnetic field 1004 produced by resolver A 1006 is shown rotating around the axis of resolver A. In addition, the reflector element 202 is shown producing a control field 1008 that reverses its North and South polarities. Note that the North and South polarities reverse as the resultant magnetic field 1004 passes through the reflector element 202. The net result, as shown in FIG. 10, is translation to the right.

Note also that, as shown in FIG. 8, the angle drive segment 810 persists over multiple rotations of the resultant magnetic field produced by resolver A. That is, the reflector element 202 may translate while the South pole of the resultant magnetic field 1004 is passing by the reflector element 202. When the South pole rather than the North pole of the resultant magnetic field 1004 is being used to translate the reflector element 202, the reflector element 202 must reverse its control field 1008 North and South poles to translate in the same direction that it would translate under influence of the North pole of the resultant magnetic field 1004. The sequencer 730 keeps track of the time (the "reverse" time) during which the South pole of the resultant magnetic field 1004 is used to translate the reflector element 202. During the reverse time, the sequencer 730 negates the multiplication of multiplier 762 to flip the North and South poles of the control field 1008. Note that during the reverse time, the comparator 732 still operates to flip the North and South poles of the control field 1008 when the South pole of the resultant magnetic field 1004 passes through the reflector element 202.

In the negative translation adjustment 1002, the resultant magnetic field 1004 produced by resolver A 1006 also rotates around the axis of resolver A 1006. In addition, the reflector element 202 is shown producing a control field 1008 that reverses its North and South polarities as the resultant magnetic field 1004 passes through the reflector element 202. The net result, as shown in FIG. 10, is translation to the left. As described above with reference to the positive translation adjustment 1000, the comparator 732 and sequencer 730 operate to flip the North and South poles of the control field 1008 based on whether the North or South pole of the resultant magnetic field 1004 is motivating the translation or is passing through the reflector element 202.

After resolver A has finished its cycle of operation, resolver B, then resolver C complete the identical process described above with reference to resolver A. As shown in FIG. 8, the resolvers operate sequentially. When resolver C finishes its cycle of operation, the overall cycle begins again with the operation of resolver A. Thus, the collaboration of resolver A, resolver B, and resolver C allow the reflector element 202 to attain the commanded pitch and position.

In some circumstances, the reflector element 202 will be released during satellite setup with its detector 706 turned partially away from the illuminator 216. In such a case, the detector 706 may detect transmission error conditions, or the power source 312 may indicate a low power condition. Under such conditions, the reflector element controller 314, may use the magnetic transceiver 310 to produce a control field to adjust the pitch and position of the reflector element 202. The resultant magnetic fields generated by resolver A 209, resolver B 210, and resolver C 211 then move the reflector element 202. Note that the reflector element 202 may not have a commanded pitch and position yet, but will simply ride the resultant magnetic fields until transmissions from the illuminator 216 are more strongly received.

Alternative Embodiments

Figure 11A:
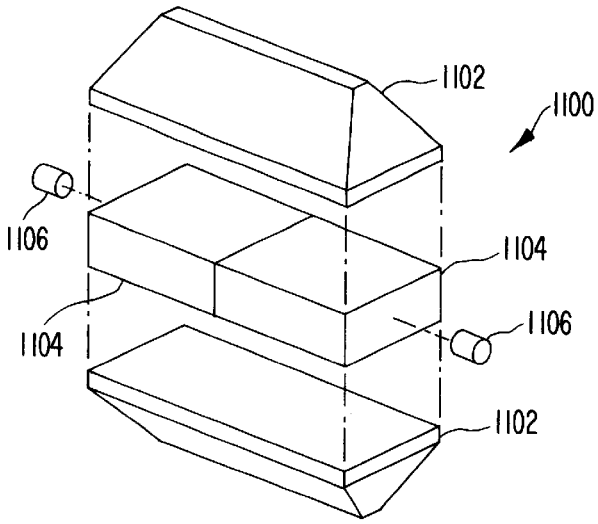
FIG. 11*a* illustrates one possible construction of a rare-Earth permanent magnet resolver.

In an alternative embodiment of the present invention, the resolver A 209, resolver B 210, or resolver C 211 may consist of a permanent magnet constructed in part, for example, with rare-Earth magnetic materials. In order to control a permanent magnet, the deflection yoke 206 may include, for example, rotating pivots to which the permanent magnet is secured. The array control processor 208 may then produce a rotating magnetic field by rotating the permanent magnet rather than by driving current through the first coil 212 and second coil 214. Alternatively, the array control processor 208 may use the first coil 212 and second coil 214 in conjunction with the permanent magnet. Turning to FIG. 11*a,* a rare-Earth permanent magnet resolver 1100 is illustrated. The permanent magnet resolver 1100 includes magnet pole pieces 1102, rare-Earth permanent magnets 1104, and pivots 1106.

The magnet pole pieces 1102 are constructed from materials that help prevent the permanent magnet 1104 magnetic field from radiating through the pole pieces 1102 as opposed to perpendicular to the permanent magnet 1104.

Figure 11B:
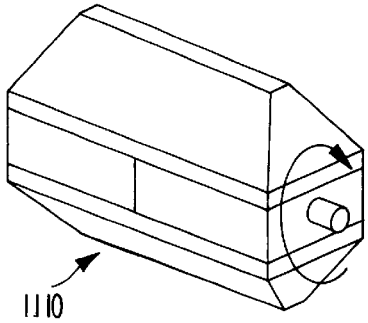
FIG. 11*b* shows a permanent magnet resolver assembly.

The pivots 1106 attach to and allow the permanent magnets 1104 and pole pieces 1102 to rotate around the axis defined by the pivots 1106. The pivots may be implemented in a variety of manners, including ball bearings, cylindrical rods, and the like. FIG. 11*b* shows a complete rare-Earth permanent magnet assembly 1110.

Figure 11C:
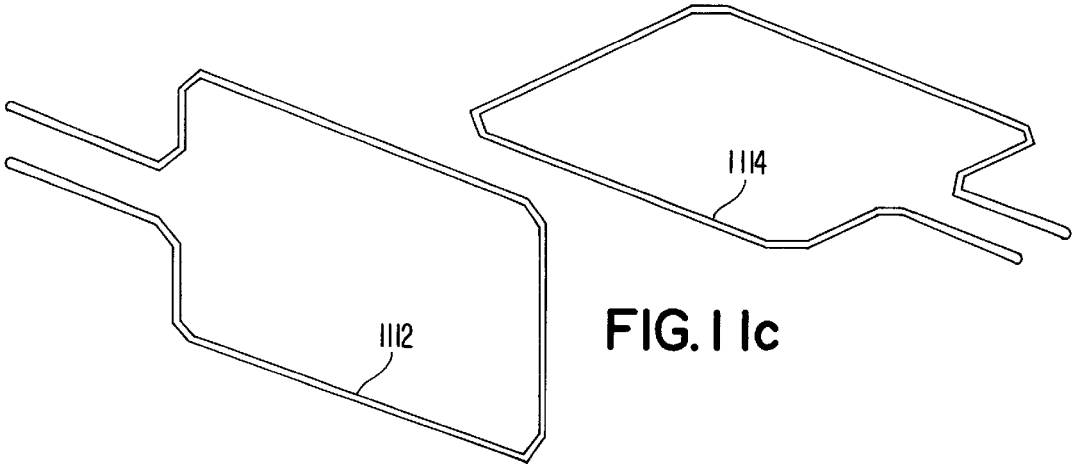
FIG. 11*c* shows two coils that may be used to form a resolver.
Figure 11D:
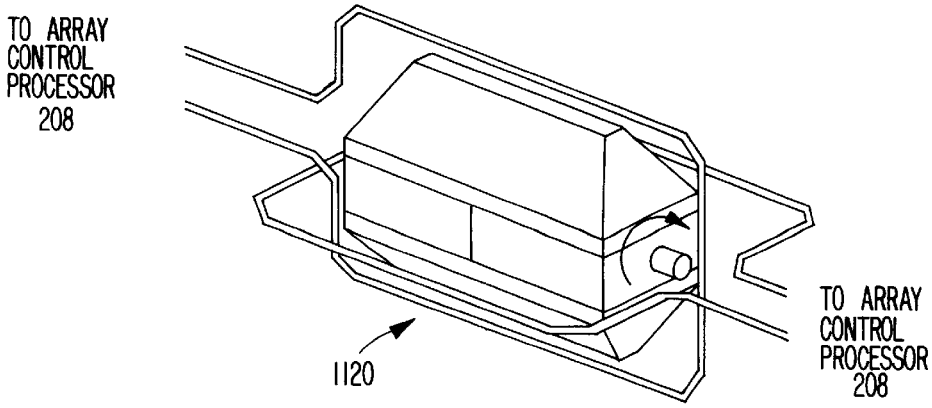
FIG. 11*d* illustrates a resolver assembly including two coils and a permanent magnet.

FIG. 11*c* illustrates a first magnet coil 1112 and a second magnet coil 1114 at right angles to one another. The first and second magnet coils 1112 and 1114 are analogous to the first coil 212 and the second coil 214 described above. Together with the rare-Earth permanent magnet assembly 1110, the first and second magnet coils 1112 and 1114 may be used to construct a resolver assembly 1120 as shown in FIG. 11*d.* As with the first coil 212 and second coil 214, the first and second magnet coils 1112 and 1114 may be connected to and controlled by the array control processor 208 to generated magnetic fields and cause the rare-Earth permanent magnet assembly 1110 to rotate.

In another embodiment of the present invention, the reflector element controller 314 may be implemented in part with power saving analog devices. For example, in the command setup section 702, the outputs of the pitch and angle registers 712–722 may be converted to analog with D/A converters. Then, the pitch multiplexer 724 and the angle multiplexer 726 may be replaced with Field Effect Transistor (FET) analog switches. Many of the devices in the control loop section 706 may also then be replaced with analog equivalents.

For example, the adders 754, 756, 758, and 760 may be replaced with operational amplifiers. The divider 766 may be replaced with an R-2R resistor voltage divider, or the equivalent, and the multiplier 764 may be replaced with an analog switch that is able to multiply its input by +1 or −1 under control of the multiplier 762. Each of the registers 736–742 and 735 may be replaced with sample and hold circuitry consisting of, for example, a switch, a capacitor, and an amplifier. Furthermore, the multiplexer 744 may be replaced with an FET analog switch, and the comparators 734 and 732 may be replaced with difference amplifiers. A D/A converter may be provided to convert the output of the counter 728 to analog for the sample and hold replacement of register 735.

Additionally, the midpoint bias 768 may be replaced by a reference voltage which may be generated, for example, by a resistor divider network. The output of the FET analog multiplexer replacement of multiplexer 744 may then be connected directly to buffer 750 and the D/A converter 746 and A/D converter 748 eliminated.

While particular elements, embodiments and applications of the present invention have been shown and described, it is understood that the invention is not limited thereto since modifications may be made by those skilled in the art, particularly in light of the foregoing teaching. It is therefore contemplated by the appended claims to cover such modifications as incorporate those features which come within the spirit and scope of the invention.

I claim:

1. An adaptive antenna array comprising:

(a) a plurality of resolvers;

(b) an array control processor for regulating said plurality of resolvers to generate independent magnetic fields, said array control processor also generating reflector element command and control information;

(c) a transmitter connected to said array control processor for transmitting said command and control information; and (d) a plurality of reflector elements, each reflector element comprising:

(d)(1) a signal reflector;

(d)(2) a magnetic transceiver;

(d)(3) a detector for receiving said command and control information; and (d)(4) a reflector element controller connected to said detector and further connected to said magnetic transceiver, said reflector element controller interpreting said command and control information and sensing interactions between said independent magnetic fields and said magnetic transceiver, said reflector element controller also generating a control field with said magnetic transceiver to interact with said independent magnetic fields and motivate said reflector element to a pitch and a position in accordance with said command and control information.

2. The adaptive antenna array of claim 1, wherein said plurality of reflector elements each further includes a power source.

3. The adaptive antenna array of claim 2, further comprising at least one illuminator for providing power to said plurality of reflector elements.

4. The adaptive antenna array of claim 2, wherein said transmitter also operates as an illuminator that provides power to said plurality of reflector elements.

5. The adaptive antenna array of claim 1, wherein at least one of said plurality of resolvers comprises:

(a) a first conductive winding aligned along an axis; and (b) a second conductive winding aligned along said axis and arranged substantially perpendicular to said first conductive winding such that said first conductive winding and said second conductive winding are able to generate a resultant magnetic field that rotates around said axis.

6. The adaptive antenna array of claim 1, wherein at least one of said plurality of resolvers comprises:

(a) a rotatable pivot; and (b) a magnet secured to said rotatable pivot.

7. The adaptive antenna array of claim 6, wherein said at least one of said plurality of resolvers further comprises a pole piece attached to said magnet.

8. The adaptive antenna array of claim 6, wherein said magnet comprises rare-Earth elements.

9. The adaptive antenna array of claim 5, wherein said at least one of said plurality of resolvers further comprises:

(a) a rotatable pivot; and (b) a magnet secured to said rotatable pivot.

10. The adaptive antenna array of claim 9, wherein said at least one of said plurality of resolvers further comprises a pole piece attached to said magnet.

11. The adaptive antenna array of claim 9, wherein said magnet comprises rare-Earth elements.

12. The adaptive antenna array of claim 1, wherein said plurality of resolvers is arranged in substantially an equilateral triangle.

13. The adaptive antenna array of claim 5, wherein said plurality of resolvers is arranged in substantially an equilateral triangle.

14. The adaptive antenna array of claim 6, wherein said plurality of resolvers is arranged in substantially an equilateral triangle.

15. The adaptive antenna array of claim 1, further comprising a radome placed in front of said plurality of resolvers for limiting the volume through which said plurality of reflector elements may drift.

16. The adaptive antenna array of claim 1, wherein said transmitter transmits said command and control information in a TDM format.

17. The adaptive antenna array of claim 16, wherein said TDM format includes a data field comprising pitch and position information.

18. The adaptive antenna array of claim 17, wherein said array control processor generates said data field in response to an adaptive array algorithm processed by said array control processor.

19. The adaptive antenna array of claim 1, wherein at least one of said plurality of reflector elements comprises a semiconductor substrate.

20. The adaptive antenna array of claim 19, wherein said magnetic transceiver comprises a plurality of turns of a conductive trace fabricated on said semiconductor substrate.

21. The adaptive antenna array of claim 2, wherein said power source comprises a photovoltaic cell fabricated on a semiconductor substrate.

22. The adaptive antenna array of claim 19, wherein said reflector element controller is fabricated on said semiconductor substrate.

23. The adaptive antenna array of claim 22, wherein said reflector element controller is fabricated substantially in CMOS technology.

24. The adaptive antenna array of claim 1, wherein said magnetic transceiver comprises a Helmholtz coil.

25. A reflector element for adjusting beam components in an adaptive array antenna, the reflector element comprising:

a signal reflector;

a magnetic transceiver;

a detector for receiving command and control information; and a reflector element controller connected to said detector and further connected to said magnetic transceiver, said reflector element controller interpreting said command and control information and sensing interactions between external independent magnetic fields and said magnetic transceiver, said reflector element controller also generating a control field with said magnetic transceiver to interact with said external independent magnetic fields and motivate said reflector element to a pitch and a position in accordance with said command and control information.

26. The reflector element of claim 25, wherein said reflector element comprises a semiconductor substrate.

27. The reflector element of claim 26, wherein said magnetic transceiver comprises a plurality of turns of a conductive trace fabricated on said semiconductor substrate.

28. The adaptive antenna array of claim 25, wherein said power source comprises a photovoltaic cell fabricated on a semiconductor substrate.

29. The adaptive antenna array of claim 26, wherein said reflector element controller is fabricated on said semiconductor substrate.

30. The adaptive antenna array of claim 29, wherein said reflector element controller is fabricated substantially in CMOS technology.

31. The adaptive antenna array of claim 29, wherein said reflector element controller is implemented with CMOS devices in conjunction with analog devices.

32. The adaptive antenna array of claim 25, wherein said magnetic transceiver comprises a Helmholtz coil.

* * * * *